US006418944B1

(12) United States Patent
White et al.

(10) Patent No.: US 6,418,944 B1
(45) Date of Patent: Jul. 16, 2002

(54) METHOD AND APPARATUS FOR CLEANING SPRAY GUNS

(76) Inventors: Kevin R. White, 2440 Headon Road, Burlington, ON (CA), L7R 3X5; James J. Kay, 1375 Treeland Street, Burlington, ON (CA), L7R 4P4

( * ) Notice: Subject to any disclaimer, the term of this patent is extended or adjusted under 35 U.S.C. 154(b) by 0 days.

(21) Appl. No.: 10/036,422

(22) Filed: Jan. 7, 2002

Related U.S. Application Data

(62) Division of application No. 09/068,739, filed as application No. PCT/CA96/00756 on Nov. 18, 1996, now Pat. No. 6,355,114.

(51) Int. Cl.[7] ..... B08B 3/02

(52) U.S. Cl. ..... 134/104.1; 134/167 R; 134/179

(58) Field of Search ..... 134/95.2, 95.3, 134/104.1, 167 R, 168 R, 170, 176, 179

(56) References Cited

U.S. PATENT DOCUMENTS 2,992,781 A * 7/1961 Howard, Sr. ..... 134/179 X
4,418,868 A 12/1983 Gurubatham et al.
4,977,911 A 12/1990 Vetter et al.
5,183,066 A 2/1993 Hethcoat

FOREIGN PATENT DOCUMENTS

| | | |
|---|---|---|
| EP | 0333040 | 9/1989 |
| JP | 3127661 | 5/1991 |
| JP | 6165958 | 6/1994 |
| WO | 8905694 | 6/1989 |

* cited by examiner

*Primary Examiner*—Philip Coe
(74) *Attorney, Agent, or Firm*—Dowell & Dowell, P.C.

(57) ABSTRACT

An apparatus (10, 300, 400) for cleaning spray guns (18, 418) has a closed vessel (14) having an inlet (24, 424), a drain (22, 422) and a port (29) for receiving a nozzle (30) of a spray gun. A spray impeller (36, 136, 236, 336, 436) is rotatably mounted within the vessel (14) and in fluid communication with the inlet (24, 424). The spray impeller (36, 136, 236, 336, 436) has an offset cleaning nozzle (42, 44, 144, 141, 142, 282, 244, 442, 444) for projecting a cleaning spray towards the port (29) and a rotational nozzle (46, 48, 148, 246, 248, 446, 448) for projecting a rotational spray to effect rotation of the spray impeller (36, 136, 236, 336, 436). The port (29) has a seal (76, 78, 80) for sealing receiving the spray gun (18, 418) and positioning the nozzle (30) of the spray gun in the cleaning spray.

20 Claims, 9 Drawing Sheets

METHOD AND APPARATUS FOR CLEANING SPRAY GUNS

This application claims the benefit of and is a divisional of the U.S. Patent application, Ser. No. 09/068,739 which was filed on May 15, 1998, and now U.S. Pat. No. 6,355,114, entitled, METHOD AND APPARATUS FOR CLEANING SPRAY GUNS by inventors, Kevin R. White and James J. Kay which is the National Stage of PCT/CA96/00756, filed Nov. 18, 1996.

FIELD OF INVENTION

This invention relates to a method and apparatus for cleaning paint spray guns. In particular, the invention relates to an apparatus for cleaning spray guns, including a novel cover member for allowing the paint spray guns to be easily maneuvered into and positioned within the apparatus for cleaning thereof.

BACKGROUND OF THE INVENTION

Paint spray guns are used in a variety of industries to project paint onto an object. In the automobile industry, a particular paint spray gun may be used to spray a number of paint coats of different colours onto parts for automobiles. The paint spray gun must be regularly cleaned to remove curing and dry paint in the nozzle end of the spray gun, and prior to the use of paint of a new colour, to remove remnants of the first paint.

Paint spray guns are cleaned by projecting solvents at high velocity at the paint spray guns contained within an apparatus. The high velocities are required to remove dried paint from the nozzle end of the gun. The cleaning is effected in a separate vessel to prevent leakage of spent solvent.

U.S. Pat. No. 4,830,882 discloses a method and apparatus for cleaning paint spray guns which includes a cleaning tank and two flexible cover members having holes for inserting a paint spray gun therethrough. A plurality of cleaning nozzles are disposed within the cleaning tank to project a cleaning fluid onto the paint spray gun to clean the paint spray gun. The arrangement of the cleaning nozzles within the cleaning tank does not necessarily provide a full cleaning of the paint spray gun since full cleaning depends upon the placement of the cleaning nozzles within the cleaning tank and the angle at which the cleaning fluid is projected onto the paint spray gun. Also, the requirement that the nozzles must be appropriately arranged to effectively project cleaning fluid at the paint spray gun makes the apparatus complicated for manufacture and repair.

SUMMARY OF THE INVENTION

The disadvantages of the prior art may be overcome by providing an apparatus for cleaning a spray gun having a rotating spray nozzle for projecting a cleaning spray and a rotational nozzle for projecting a spray to effect rotation and to wet an interior surface of containment vessel.

It is desirable to provide a method of cleaning a paint spray gun in a cleaning vessel, comprising the steps of positioning the paint spray gun within the cleaning vessel, rotating a plurality of cleaning nozzles and applying a spray of cleaning fluid through the plurality of nozzles at the paint spray gun; purging the nozzles for cleaning fluid; and applying air to the paint spray gun through the spray nozzles to dry the paint spray gun.

Accordingly to another aspect of the invention, there is provided a method of cleaning a nozzle of a spray gun. The steps comprise positioning a nozzle of a spray gun in a port of a vessel in a sealing relation. Initiating a fluid flow of a first fluid through a rotatably mounted impeller having a cleaning nozzle and a rotational nozzle. The fluid flow through the cleaning nozzle effects an offset cleaning spray directed at the spray gun and the fluid flow through the rotational nozzle effects rotation of the impeller and wets an interior surface of the vessel. Collecting the fluid from the vessel. Initiating the fluid flow with a second fluid for purging the impeller of the first fluid.

According to one aspect of the invention, there is provided an apparatus for cleaning spray guns has a closed vessel having an inlet, a drain and port for receiving a nozzle of a spray gun. A spray impeller is rotatably mounted within the vessel and in fluid communication with the inlet. The spray impeller has an offset cleaning nozzle for projecting a cleaning spray towards the spray gun and a rotational nozzle for projecting a rotational spray to effect rotation of the spray impeller. The port has a seal for sealingly receiving the spray gun and positioning the nozzle of the spray gun in the cleaning spray.

According to another aspect of the invention, there is provided a cover member which enables a paint spray gun to be easily maneuvered into and positioned within the apparatus.

The method and apparatus of the invention provides a number of advantages. First, the interior of the cleaning vessel is continuously cleaned by the cleaning fluid expelled by the cleaning and rotational nozzles. Second, the paint removed from the paint spray gun and the solvent required for cleaning do not escape to the surrounding environment. Third, 360° coverage and the direct impingement angle afforded by the rotating impeller design provide a more effective removal of paint from the paint spray gun. Fourth, the apparatus is easily repaired and requires relatively low maintenance compared to existing apparatus for cleaning paint spray guns.

BRIEF DESCRIPTION OF THE DRAWINGS

The method and apparatus of the invention will now be described with reference to the accompanying drawings, in which.

DETAILED DESCRIPTION OF THE INVENTION

Figure 2:
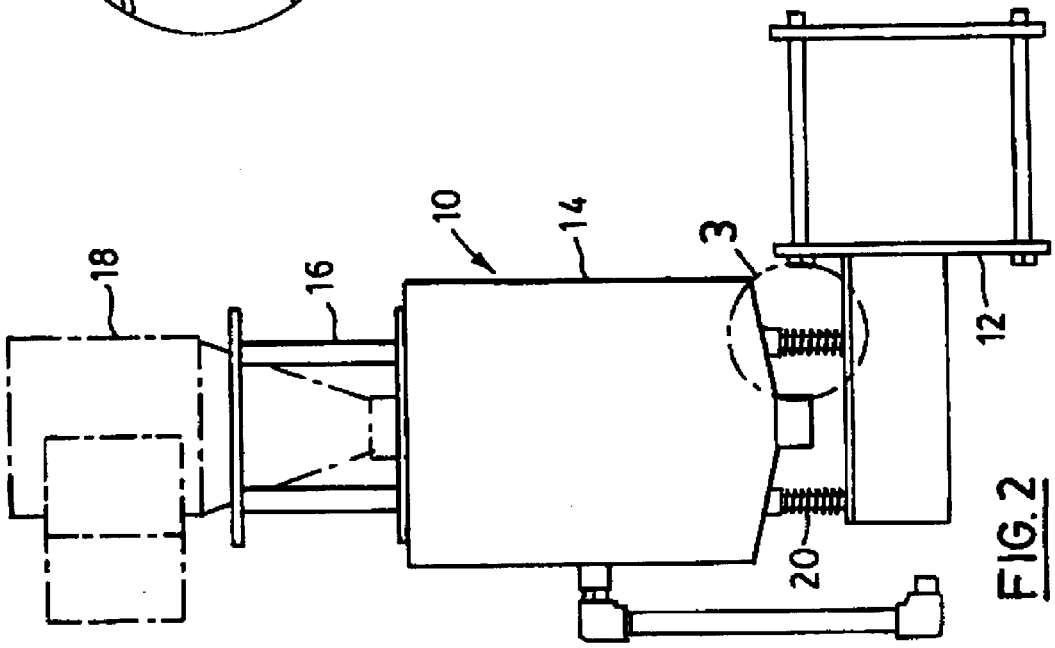
FIG. 2 is a side elevational view of the embodiment of FIG. 1.
Figure 1:
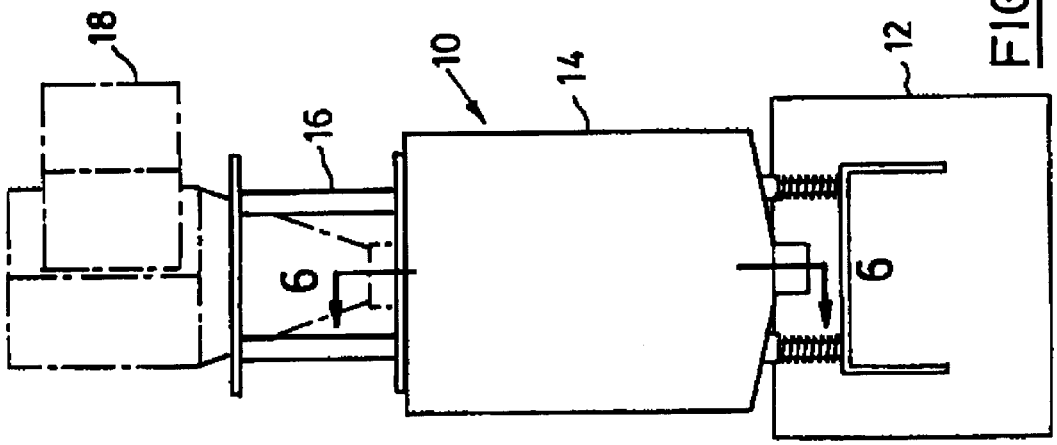
FIG. 1 is a front elevational view of a first embodiment of a spray gun cleaning apparatus of the present invention.

Referring to FIG. 1 and 2, the cleaning apparatus 10 for cleaning paint from spray guns is illustrated. The apparatus 10 generally comprises a base 12, a hollow sealed vessel 14 and a spray gun mount 16 for receiving a spray gun 18 (illustrated in phantom lines).

Figure 3:
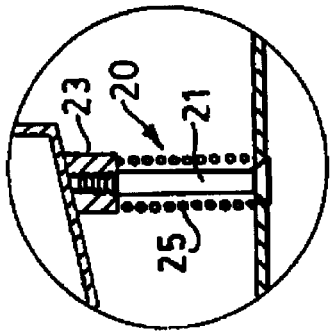
FIG. 3 is an enlarged sectional side view of the resilient support for the cleaning vessel of the embodiment of FIG. 1.

Referring to FIG. 3, vessel 14 is mounted on base 12 by spring mounts 20. Spring mount 20 each has a pin 21 in sliding engagement with a boss 23 on the base of vessel 14. Spring 25 resiliently mounts the vessel 14 onto base 12.

Figure 5:
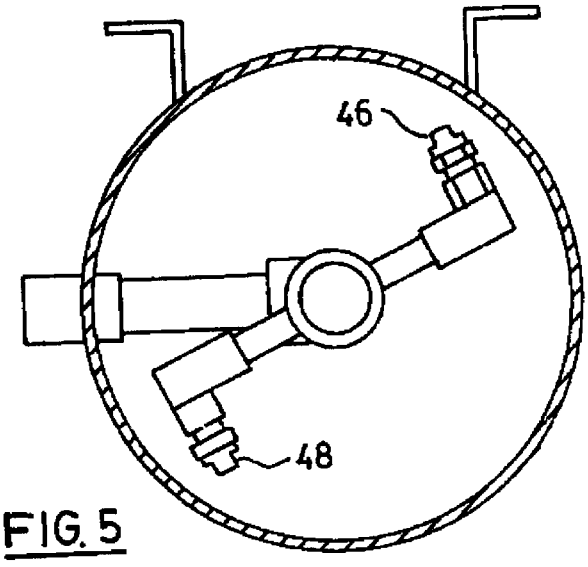
FIG. 5 is a partial sectional plan view of the embodiment of FIG. 4.
Figure 4:
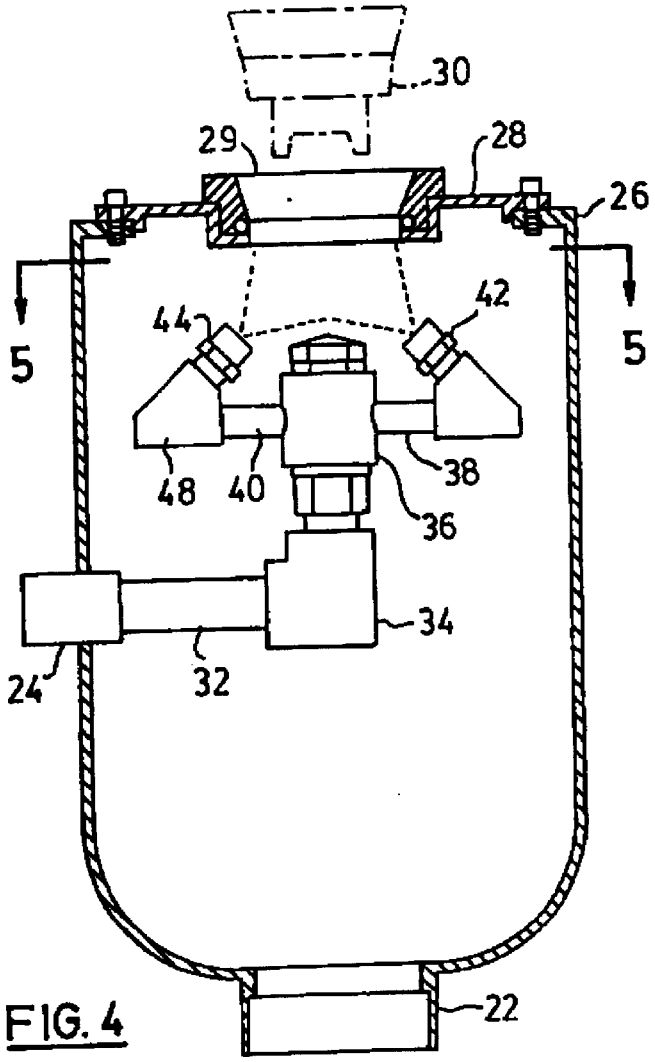
FIG. 4 is a partial sectional side view of the cleaning vessel of the embodiment of FIG. 1 along line 6—6.

Referring to FIGS. 4 and 5, the interior of vessel 14 is illustrated. Vessel 14 is a generally hollow vessel having a drain 22 at the bottom thereof, and an inlet fitting 24 and a top annular plate 26 having an annular opening therein. The annular opening is closed by a cover assembly 28. Cover assembly 28 has a port 29 which receives the nozzle 30 of spray gun 18 in a sealing engagement.

Extending from inlet fitting 24 is a pipe or tube 32 connected to an elbow fitting 34 which has a vertical axis substantially collinear with a central vertical axis of vessel 14. Extending upwardly and in fluid communication with the inlet fitting 24 is impeller 36. Inlet fitting 24, pipe 32 and elbow fitting 34 has sufficient structural integrity to firmly support impeller 36. Arms 38 and 40 extend diagonally outwardly from impeller 36. Cleaning nozzles 42 and 44 extend inwardly from the distal end of arms 38 and 40, respectively, at preferably at an angle of 45° towards the axis of rotation. Horizontally directed rotational nozzles 46 and 48 are mounted at the distal ends of arms 38 and 40, respectively. Rotational nozzles 46 and 48 extend tangentially to the rotation of the impeller 36.

Figure 6:
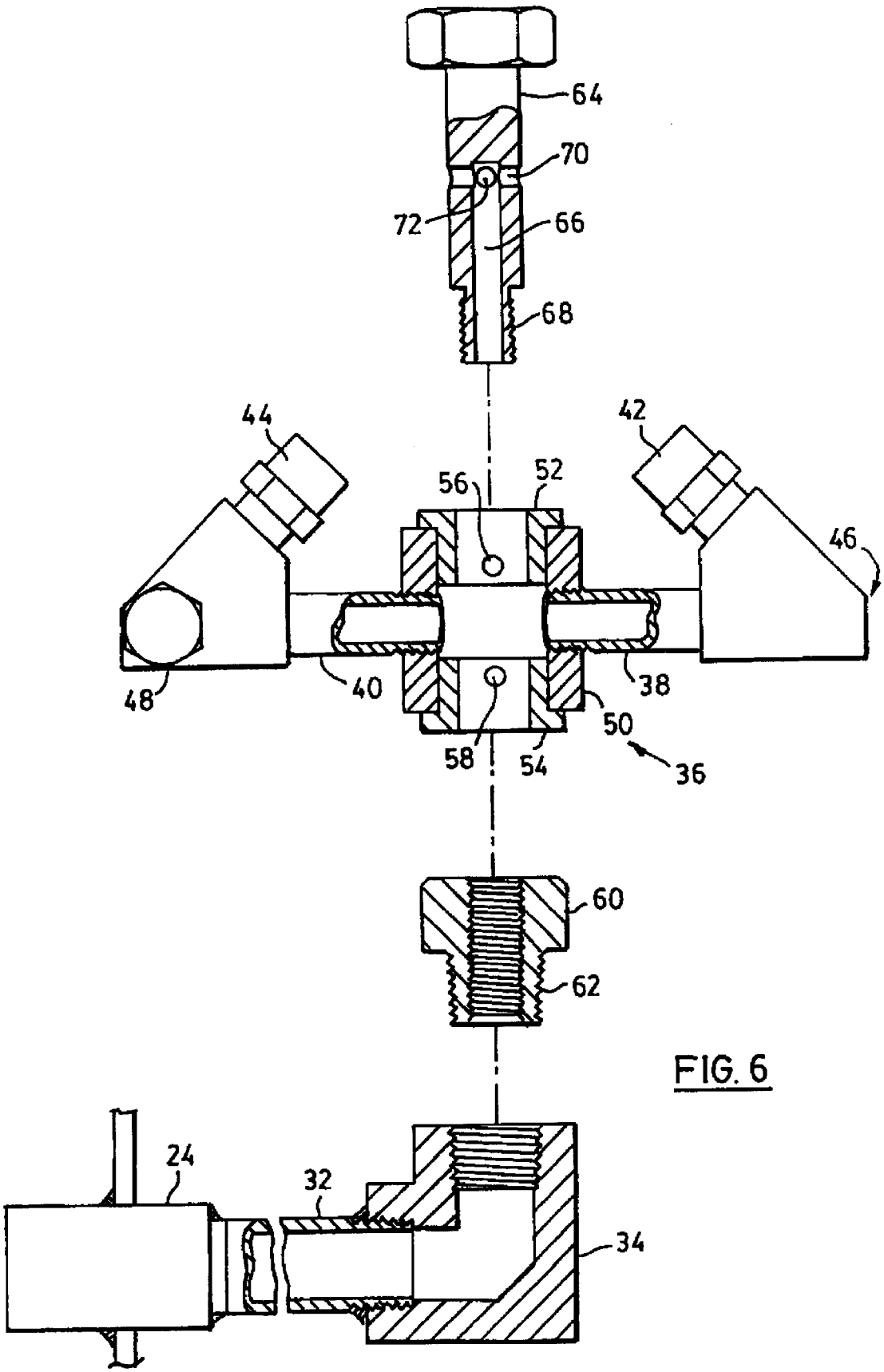
FIG. 6 is an exploded partially sectional view of the nozzle structure of the embodiment of FIG. 1.

Referring now to FIG. 6, the impeller 36 is illustrated in greater detail. Impeller 36 comprises a tubular sleeve 50, having diagonally opposed threaded apertures for threadingly receiving arms 38 and 40. Bushings 52 and 54 are generally cylindrical having a flange extending about one end thereof and are sized to be inserted to each end of sleeve 50. Pins 56 and 58 retain the bushings 52 and 54, respectively, within sleeve 50. Bushings 52 and 54 are preferable made from a pliable bearing material. The material must be able to withstand the toxic nature of the solvents being used and allow the impeller 36 to rotate.

Base fitting 60 has a thread 62 for threadingly engaging elbow fitting 34. Base fitting 60 has a central aperture having an internal thread therein.

Bolt 64 has a central capillary opening 66 centrally of the stem of bolt 64. End 68 of bolt 64 has a thread for engaging the threaded aperture of base fitting 60. The upper end of capillary opening 66 has a pair of orthogonally opposed apertures 70 and 72.

When assembled, bolt 64 is inserted through sleeve 50 to engage base fitting 60. The bolt 64 is tightened until bushings 52 and 54 are compressed allowing fluid communication through the impeller 36, yet permitting the impeller 36 to rotate.

Once the cleaning apparatus 10 is assembled and sealed, fluid is able to communicate within the fluid inlet system from the inlet fitting 24, through tubing 32, upwardly about elbow 34, through impeller 36, outwardly in opposite directions through arms 38 and 40, tangentially and opposed through rotational nozzles 46 and 48 and finally upwardly at a 45° angle through cleaning nozzles 42 and 44.

Figure 7:
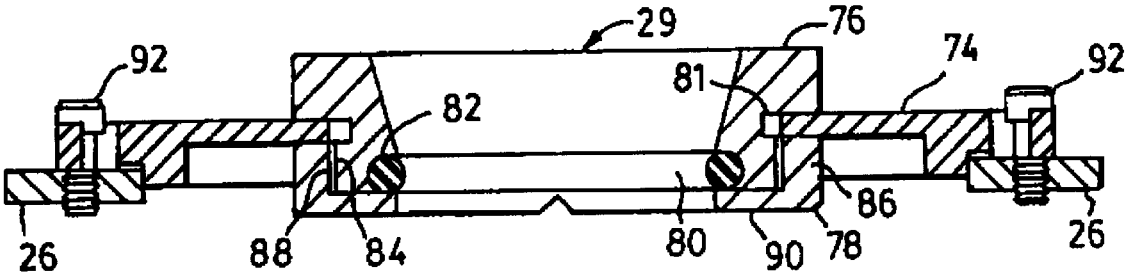
FIG. 7 is a sectional view of the seal for receiving a spray gun of the embodiment of FIG. 1.

Referring now to FIG. 7, the cover assembly 8 is illustrated in greater detail. Top pate 26 is an angular ring which extends about the upper end of vessel 14. A cover plate 74 partially closes the upper opening presented by annular top plate 26. Spray gun receiving port 29 is fitted into an annular opening in cover plate 74. The seal fitted within a circumference of port 29 comprises an outer ring 76, an inner ring 78 and a O-ring 80. Outer ring 76 has a tapered central aperture merging with a step 82. The outer circumference of the lower end of outer ring 76 has a thread 84. Inner ring 78 has a collar portion 86 having an inner circumferential surface having an inner thread 88 complementary to thread 84. Inner ring 78 has a flange 90, which extends inwardly to define an annular ridge for receiving O-ring 80. Outer ring 76 has a circumferentially extending channel 81. Channel 81 has a thickness of approximately equal to the thickness of cover plate 74 and a diameter smaller than the diameter of the aperture of the cover plate 74. Outer ring 76 and inner ring 78 cooperate for clamping onto the cover plate 74 therein and for clamping O-ring 80.

To assemble, outer ring 76 is inserted through the central aperture of cover Plate 74. O-ring 80 is inserted in the inner annular channel defined by step 82. Inner ring 78 is presented to the outer ring 76 and then threadingly engaged thereto until firmly seated within the port to the seal to the cover plate 74. Cover plate 74 is then attached to the top plate 26 by bolts 92.

The O-ring 80 is preferably made from a material sold under the trade-mark VITON, or rubber encapsulated within a TEFLON casing. Still further, the O-ring 80 could be comprised of VITON material encapsulated within a TEFLON casing, or any other material compatible with the environment dictated by the application of the present invention.

In order to clean the spray guns and the nozzles thereof, the cleaning fluid or solvent must be complimentary to the paint being used. Solvents such as acetone, methyl ethyl ketone, alcohol and other solvents known in the trade may be used. Since toxic or corrosive solvents are being used, the components of the cleaning apparatus 10 are preferably made of stainless steel.

In use, the nozzle 30 of spray gun 18 is presented to seal, since channel 81 has a diameter less than the opening of cover member 74, seal is able to slide in a horizontal plane to properly align with the nozzle 30. Spray gun 18 is pressed firmly against the seal 29 to prevent solvents from escaping therebetween.

Solvent in fluid form and under pressure is injected into the vessel 14 through fitting 24. Fluid will travel through pipe 32 about elbow 34, up into impeller 36, outwardly through arms 38 and 40. The fluid will then escape through rotational nozzles 46 and 48, which will cause a tangential spray in opposite directions, urging the impeller 36 to rotate about its axis of rotation. The spray from rotational nozzles 46 and 48 will also project cleaning fluid onto the inside walls of vessel 14. The fluid will also travel up to cleaning nozzles 42 and 44 to project a cleaning spray of fluid at nozzle 30 of spray gun 18. As is apparent, since impeller 36 is rotating and the cleaning nozzles 42 and 44 are offset from the axis of rotation of the impeller, the cleaning spray from cleaning nozzles 42 and 44 will also rotate and will apply fluid circumferentially about the nozzle 30.

Advantageously, the spray from the nozzles 46 and 48 projects onto inner side walls of the vessel 14, preventing the paint and solvent mixture from drying or curing thereon. The paint and solvent mixture travels down the inner walls of vessel 14 through drain fitting 22 for environmental disposal or recycling thereof.

The cleaning apparatus 10 may be utilized to clean a paint spray gun by positioning the paint spray gun 18 into the port 29 to project the nozzle 30 inside of the cleaning vessel 14 over the top of the impeller 36. It is apparent that when the nozzle is in sealing engagement with the port 29, the vessel 14 is substantially sealed. Substantially all cleaning fluid entering inlet fitting 24 will be exhausted together with the dissolved paint through drain fitting 22. Cleaning nozzles 42 and 44 are rotated by applying cleaning fluid under pressure to the rotational nozzles 46 and 48, projecting a rotational spray. Cleaning fluid is also supplied under pressure to the cleaning nozzles 42 and 44 projecting the cleaning spray at the positioned nozzles 30 of the paint spray gun 18. The nozzles 42, 44, 46 and 48 are then purged of cleaning fluid. Air is applied to the paint spray gun through the cleaning nozzles, 42, 44, 46 and 48 to dry the paint spray gun.

Figure 8:
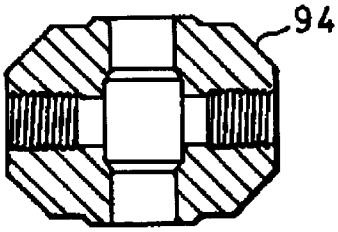
FIG. 8 is a sectional view of another embodiment of an integrated impeller assembly of the spray gun cleaning apparatus of the present invention.
Figure 9:
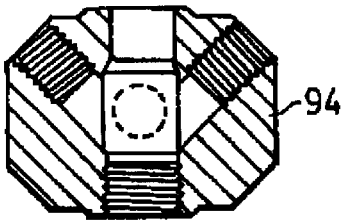
FIG. 9 is a sectional view of the integrated impeller of FIG. 8 rotated 90°.

Referring to FIGS. 8 and 9, additional embodiments of the impeller of the present invention is illustrated. In FIG. 8, the impeller 94 is an integral unit, obviating the need for bushings 52 and 54.

Figure 18:
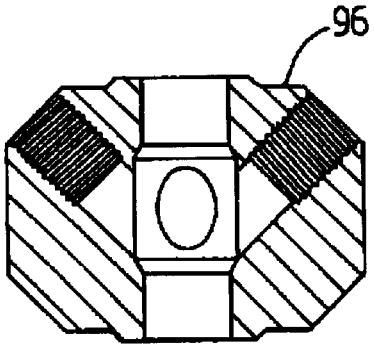
FIG. 18 is a sectional side view of another embodiment of the integrated impeller assembly of the spray gun cleaning apparatus of the present invention.
Figure 19:
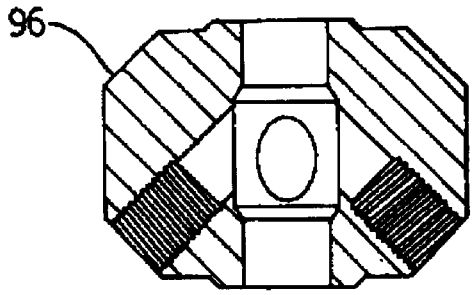
FIG. 19 is a sectional side view of the impeller of FIG. 18 rotated 90°.

Similarly in FIGS. 18 and 19, the impeller 96 is also an integral unit. The inner fluid passageways for connecting the nozzles are inclined upwardly and downwardly at 45° to the longitudinal axis of the impeller 96.

Figure 10:
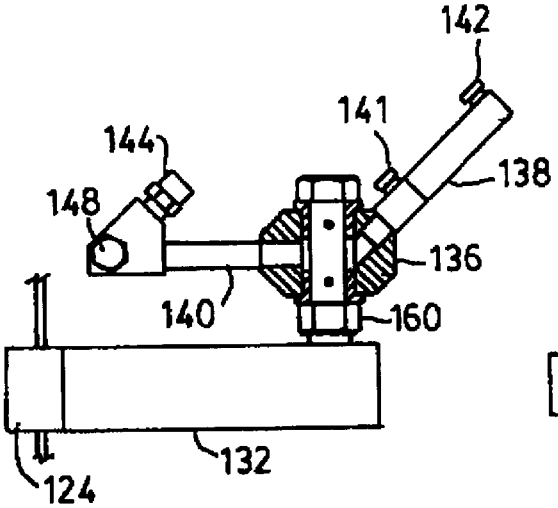
FIG. 10 is a partial side view of another embodiment of the impeller and nozzle assembly of the present invention.

Referring to FIG. 10, another embodiment of the nozzle arrangement is illustrated. In this embodiment, the tubing 132 has a closed end and an internal passageway. Base fitting 160 is in fluid communication through tubing 132 with inlet fitting 124. Arm 138 is inclined at an angle of 45° relative to the axis of rotation. Arm 140 extends horizontally and diagonally opposed from arm 138. Arm 138 has two cleaning nozzles 141 and 142.

Arm 140 has rotational nozzle 148 for providing a rotational force and a vessel cleaning spray. Nozzle 144 is directed at an angle of 45° to the axis of rotation to provide a cleaning spray.

Figure 11:
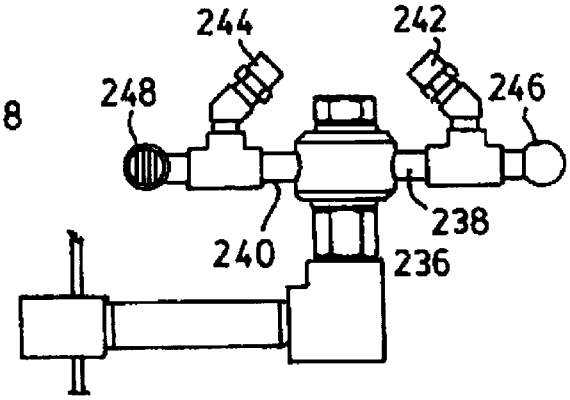
FIG. 11 is a partial side view of another embodiment of the impeller and nozzle assembly of the present invention.

Referring to FIG. 11, an additional embodiment is illustrated. In this embodiment, arms 238 and 240 are diagonally opposed and extend horizontally. Rotational nozzles 246 and 248 are in fluid communication with the impeller 236 to provide the rotational forces for the impeller 236 and the spray for cleaning the inner wall of vessel 14. Arms 238 and 240 have T-joint for connecting cleaning nozzles 242 and 244, respectively, which are canted at 45° to provide the cleaning spray.

Figure 12:
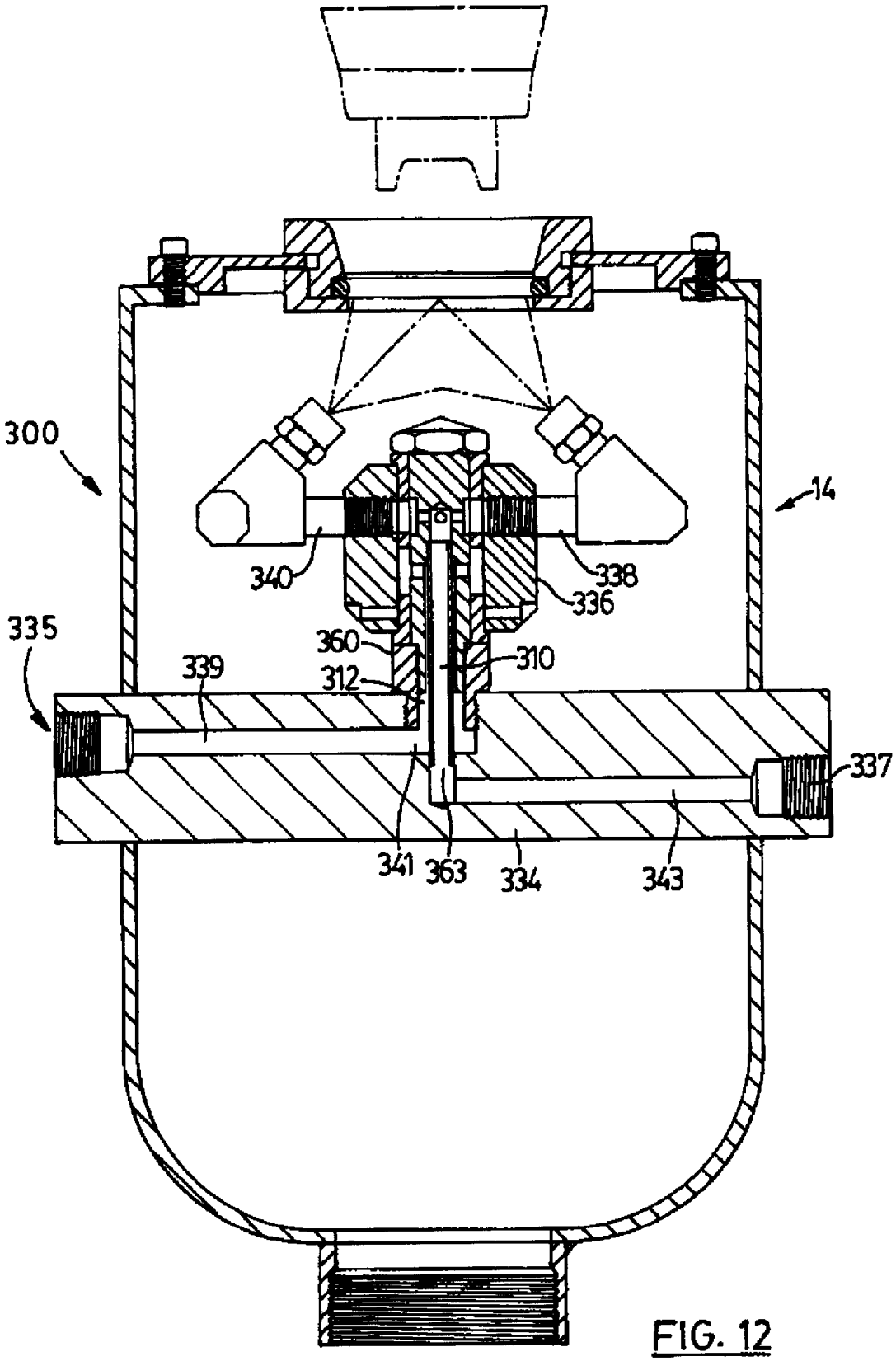
FIG. 12 is a partial sectional side view of a second embodiment of the apparatus for cleaning paint spray guns of the present invention.

Referring to FIG. 12, the cleaning apparatus 300 has an impeller 336 having a base fitting 360 threadingly engaging an inlet fitting 334. Inlet fitting 334 extends across cleaning vessel 14 for providing inlet 335 and 337. Inlet 335 communicates with internal passageway 339, which communicates with cavity 341, which threadingly receives base fitting 360. Inlet 337 communicates with internal passageway 343.

Figure 14:
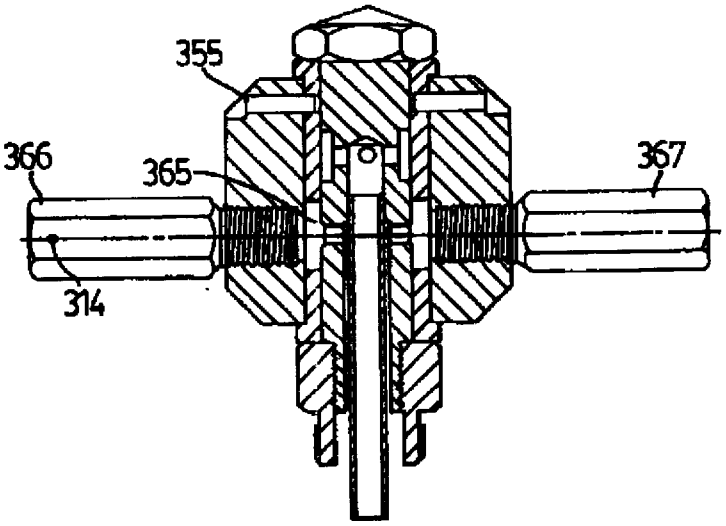
FIG. 14 is a side sectional view of the impeller of FIG. 13 rotated 90°.
Figure 13:
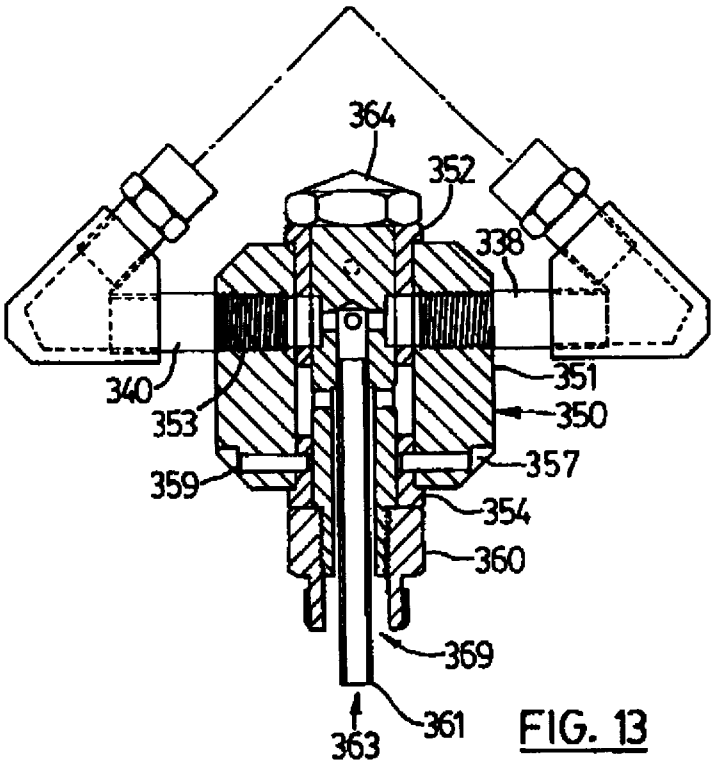
FIG. 13 is a side sectional view of the impeller of FIG. 12.

Referring now to FIGS. 13 and 14, the impeller 336 is illustrated in greater detail. The impeller 336 comprises annular sleeve 350 having apertures 351 and 353, which are diagonally opposed and adapted for receiving arms 338 and 340. Bushing 352 is inserted into one end of a longitudinal hollow of sleeve 350. Roll pin 355 retains bushing 352 in sleeve 350. Similarly, at an opposite end of sleeve 350, bushing 354 is inserted therein. Sleeve 350 has apertures 357 and 359 for receiving roll pins to retain bushing 354 within sleeve 350. Hex bolt 364 is similar to hex bolt 64 having a longitudinal passageway 369. Additionally, hex bolt 364 has an inner sleeve 361 extending within passageway 369 defining an inner passageway 310 and an annular outer passageway 312. The end of sleeve 361 fits within the vertical section of internal passageway 343. Sleeve 361 has an opening 363 at the end of the inner passageway. Opening 363 is in fluid communication with internal passageway 343 at the vertical section thereof. The outer annular passageway 312 is in fluid communication with internal passageway 339. The upper end of the outer annular passageway is in fluid communication with arms 366 and 367.

In operation, a first fluid may be applied through inlet 337 which is in fluid communication with arms 338 and 340 via aperture 363 and inner passageway 310. Fluid is introduced through inlet 335, which is in fluid communication with arms 366 and 367 via the outer annular passageway 312. Fluid is sprayed through aperture 314 to cause rotation of the impeller 336. The fluid may be different types of solvents, or a combination of air and solvents.

Figure 15:
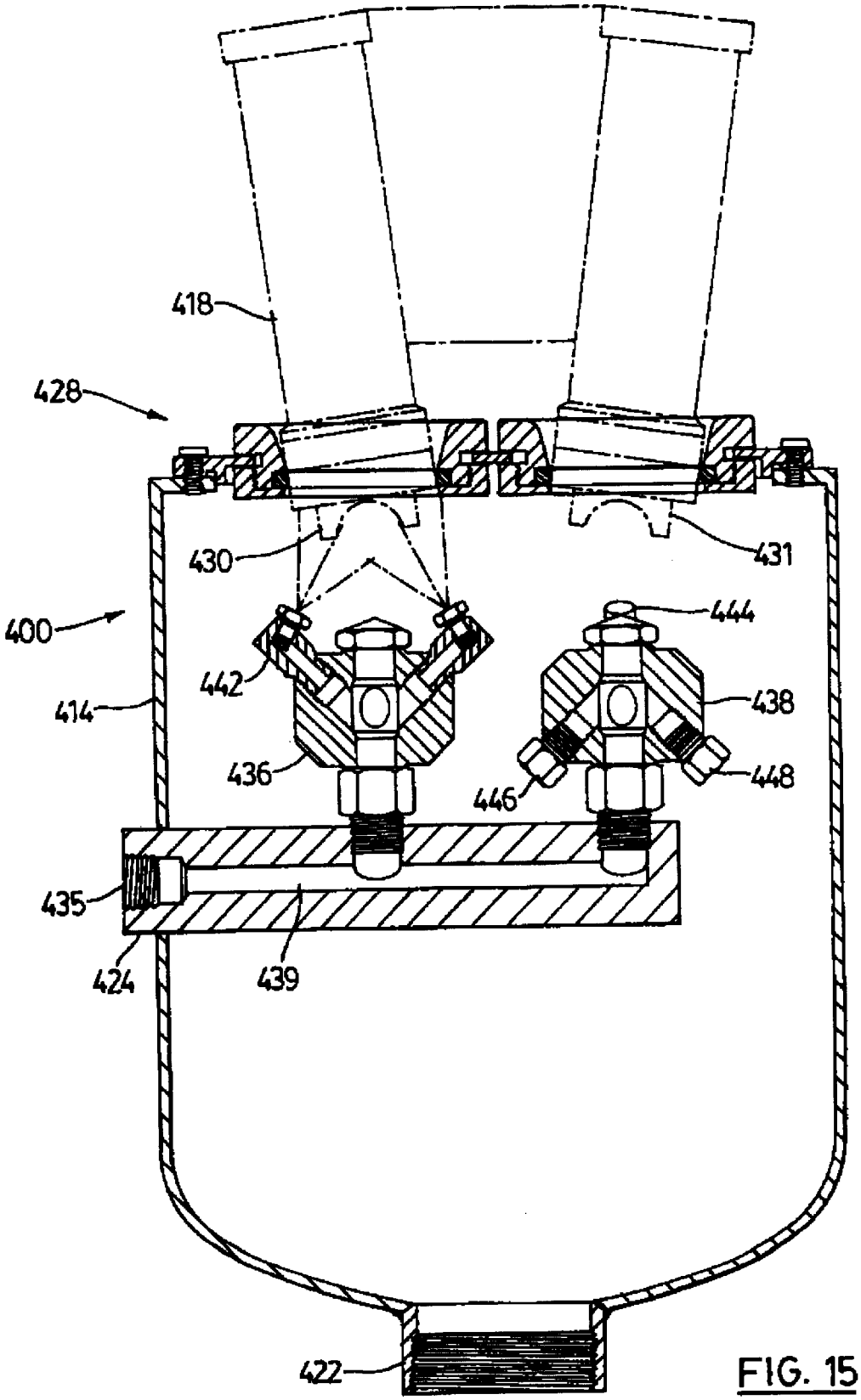
FIG. 15 is a partial sectional side view of a third embodiment of the apparatus for cleaning spray gun of the present invention.

Referring now to FIG. 15, a cleaning apparatus 400 for a dual nozzle type spray gun 418 is illustrated. In this embodiment, the vessel 414 has a cover member 428 having two sealable openings to receive nozzles 430 and 431 in sealing engagement therein. Inlet fitting 424 has an inlet 435 communicating with an internal passageway 439. A pair of like impellers 436 and 438 are mounted along inlet fitting 424 in fluid communication with inlet 435. Each of the impellers 436 and 438 are positioned immediately below nozzles 430 and 431 respectively. As each impeller 436 and 438 rotate, the spray from cleaning nozzles 444 and 442 clean spray paint gun nozzles 431 and 430, respectively. Rotational nozzles 446 and 448 provide the rotational forces for impellers 438 and 436, respectively. Rotational nozzles 446 and 448 also provide the internal surface of vessel 14 with cleaning fluid preventing build up of paints thereon enhancing the flow of solvent-paint mixture to the drain 422.

Figure 16:
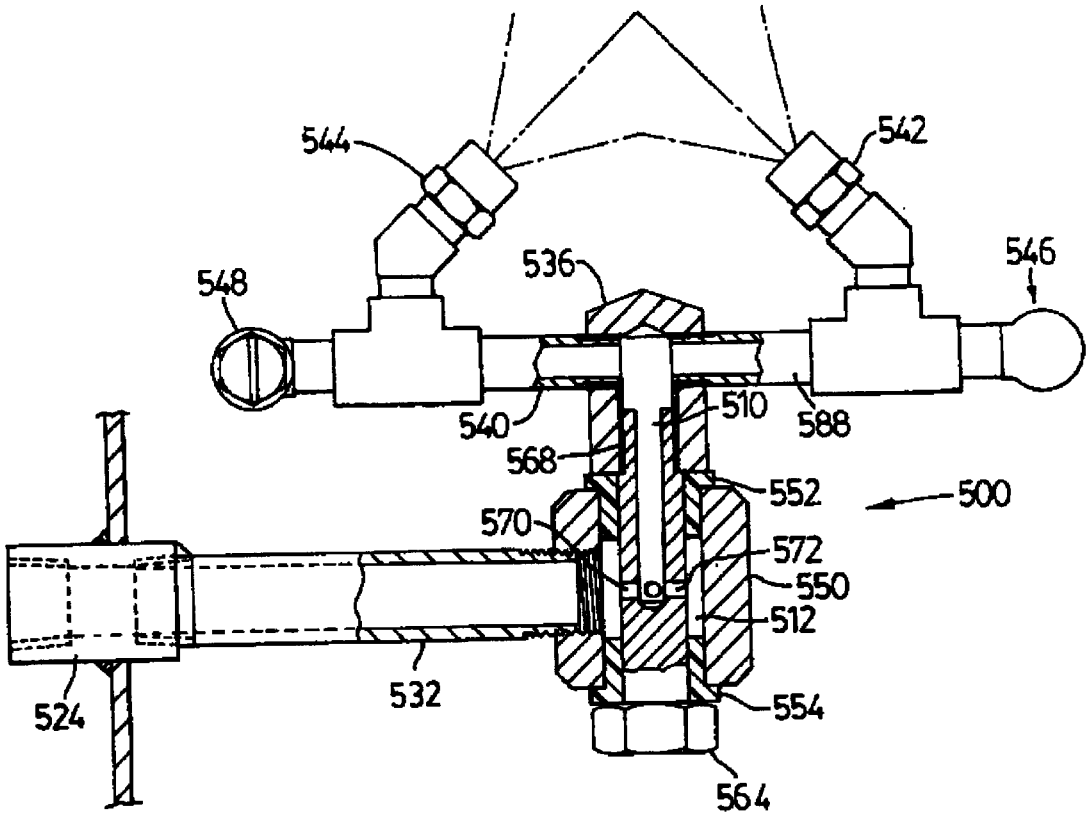
FIG. 16 is a partial side sectional view of another embodiment of an impeller of the present invention.

Referring to FIG. 16, another embodiment of the impeller 500 of the present invention is illustrated. Impeller 536 comprises a tubular sleeve 550, having an aperture for threadingly receiving tube 532 which is in fluid communication with and supported by inlet fitting 524. Bushings 552 and 554 are generally cylindrical having a flange extending about one end thereof and are sized to be inserted to each end of sleeve 550.

Bolt 564 has a central capillary opening 510 centrally of the stem of bolt 564. End 568 and 564 has a thread for engaging the threaded aperture of impeller 536. The lower end of capillary opening 510 has a pair of orthogonally opposed apertures 570 and 572 for communicating with outer annular passageway 512 which is in fluid communication with tube 532. Impeller 536 receives arms 538 and 540 for mounting rotational nozzles 546 and 548 in addition to cleaning nozzles 542 and 544. As is apparent, the impeller 536 rotates within outer sleeve 550.

Figure 17:
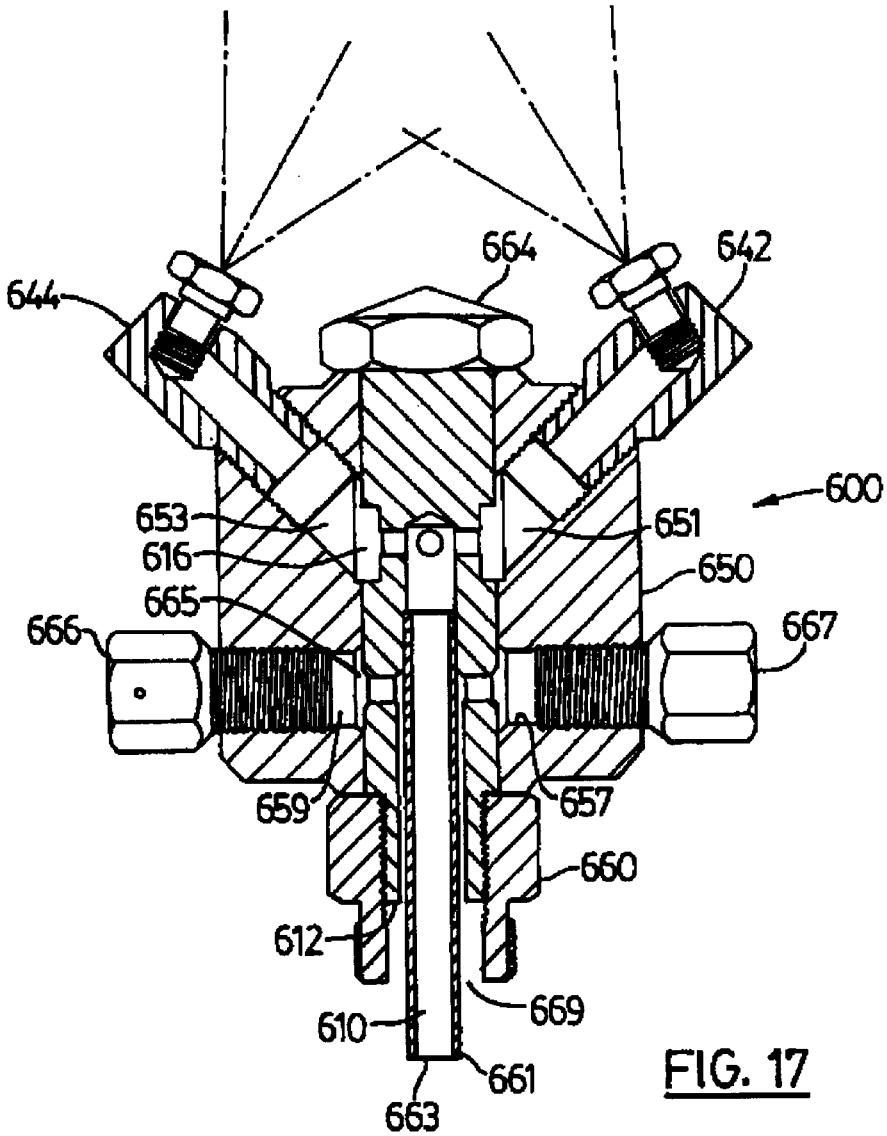
FIG. 17 is a partial side sectional view of another embodiment of an impeller of the present invention.

Referring to FIG. 17, yet another embodiment of the impeller is illustrated. Impeller 600 comprises annular sleeve 650 having apertures 651 and 653, which are diagonally opposed and canted at 45° to the axis of rotation. Apertures 651 and 653 receive cleaning nozzles 642 and 644. Sleeve 650 has apertures 657 and 659 for rotational nozzles 666 and 667. Hex bolt 364 is similar to hex bolt 64 having a longitudinal passageway 366. Additionally, hex bolt 664 has an inner sleeve 661 extending within passageway 669 defining an inner passageway 610 and an annular outer passageway 612. The inner annular passageway is in fluid communication with cleaning nozzles 642 and 644. The outer annular passageway 612 is in fluid communication with nozzles 666 and 667.

The impeller 600 is used in the same manner as impeller 336.

It is now readily apparent to a person skilled in the art that many modifications could be implemented without departing from the scope of the invention. In particular, it is now apparent that different configurations of arms and nozzles are possible provided the mass of the impeller is balanced for rotation.

We claim:

1. An apparatus for cleaning spray guns, comprising:

a closed vessel having an inlet, a drain and a port for receiving a nozzle of a spray gun;

a spray means rotatably mounted within said vessel and in fluid communication with said inlet, said spray means having an offset cleaning nozzle for projecting a cleaning spray towards said port and a rotational nozzle for projecting a rotational spray to effect rotation of said spray means;

said port having sealing means for sealingly receiving said spray gun and positioning said nozzle of said spray gun in said cleaning spray.

2. An apparatus as claimed in claim 1 wherein said rotational spray is directed at an inside surface of side walls of said vessel enhancing fluid flow therealong towards said drain.

3. An apparatus as claimed in claim 2 wherein said rotational spray is directed tangentially from an axis of rotation of the spray means.

4. An apparatus as claimed in claim 1 wherein said cleaning spray is directed at an angle of about 45° towards an axis of rotation of the spray means.

5. An apparatus as claimed in claim 1 wherein said sealing means comprises an outer seal engaging an inner seal, said outer seal and said inner seal cooperating for clamping about a circumference of said port and for clamping an O-ring.

6. An apparatus as claimed in claim 1 wherein said apparatus is resiliently mounted on a base mount.

7. An apparatus as claimed in claim 1 wherein said sealing means positions said nozzle of said spray gun directly over top of said spray means.

8. An apparatus as claimed in claim 1 wherein said apparatus further comprises a second spray means and said vessel has a second port, said port and second port positioned relative to each other to receive and position a two nozzle spray gun.

9. An apparatus as claimed in claim 8 wherein said spray means and second spray means are identical.

10. An apparatus as claimed in claim 9 wherein said spray means and said second spray means each comprises an impeller rotatably mounted on a support, said support having an internal passageway connected to said inlet for effecting said fluid communication, and a pair of diagonally opposed arms extending from said impeller, each of said arms in fluid communication with said impeller, and said arms having said rotational nozzle and said cleaning nozzle mounted thereon.

11. An apparatus as claimed in claim 10 wherein said spray means and said second spray means are mounted on a common support.

12. An apparatus as claimed in claim 11 wherein said common support has a common internal passageway for effecting said fluid communication.

13. An apparatus as claimed in claim 11 wherein said common support has two dedicated internal passageways, each in communication with a respective one of said spray means and second spray means.

14. An apparatus as claimed in claim 1 wherein said spray means comprises an impeller rotatably mounted on a support, said support having an internal passageway connected to said inlet for effecting said fluid communication, and a pair of diagonally opposed arms extending from said impeller, each of said arms in fluid communication with said impeller, and said arms having said rotational nozzle and said cleaning nozzle mounted thereon.

15. An apparatus as claimed in claim 14 wherein said rotational nozzle is directed to produce a force tangentially from an axis of rotation of said impeller.

16. An apparatus as claimed in claim 15 wherein said cleaning nozzle is directed at an angle of 45° towards said axis of rotation.

17. An apparatus as claimed in claim 16 wherein said arm is mounted at said 45° angle and said cleaning nozzle is mounted perpendicular to said arm.

18. An apparatus as claimed in claim 14 wherein each of said arms has a rotational nozzle and a cleaning nozzle.

19. An apparatus as claimed in claim 14 wherein one of said arms has said rotational nozzle and the other of said arms has said cleaning nozzle.

20. An apparatus as claimed in claim 14 wherein said spray means comprises an impeller rotatably mounted on a support, said support having a two internal passageways, one of said passageways connected to said inlet for effecting said fluid communication and the other of said passageways connected to second inlet for effecting a second fluid communication with said impeller and a second fluid.

* * * * *